US007971880B2

(12) United States Patent
Niwa et al.

(10) Patent No.: US 7,971,880 B2
(45) Date of Patent: Jul. 5, 2011

(54) TOKEN GAME MACHINE

(75) Inventors: Shinya Niwa, Yokohama (JP); Toyoji Kondou, Kawasaki (JP)

(73) Assignee: Namco Bandai Games Inc., Tokyo (JP)

( * ) Notice: Subject to any disclaimer, the term of this patent is extended or adjusted under 35 U.S.C. 154(b) by 440 days.

(21) Appl. No.: 12/181,792

(22) Filed: Jul. 29, 2008

(65) Prior Publication Data

US 2009/0033032 A1 Feb. 5, 2009

(30) Foreign Application Priority Data

Aug. 3, 2007 (JP) ..... 2007-203082

(51) Int. Cl.
*A63F 9/00* (2006.01)

(52) U.S. Cl. ..... 273/138.3; 273/138.1; 273/454

(58) Field of Classification Search ..... 273/138.1, 273/138.3, 454
See application file for complete search history.

(56) References Cited

U.S. PATENT DOCUMENTS 3,004,663 A * 10/1961 Creoglio ..... 209/654
3,457,217 A * 7/1969 Oxel ..... 521/55
4,487,414 A * 12/1984 Karkkainen et al. ..... 273/371
4,496,160 A * 1/1985 Wichinsky et al. ..... 273/369
4,726,585 A * 2/1988 Shoemaker, Jr. ..... 273/447
5,120,060 A * 6/1992 Parker et al. ..... 273/138.2
5,275,402 A * 1/1994 Malavazos et al. ..... 273/138.2
5,297,816 A * 3/1994 Becchio ..... 273/459
5,326,108 A * 7/1994 Faith ..... 273/355
5,445,138 A * 8/1995 Faith ..... 124/16
5,501,466 A * 3/1996 Welch et al. ..... 273/355
5,507,490 A * 4/1996 Hagiwara ..... 463/16
5,553,865 A * 9/1996 Shoemaker et al. ..... 273/448
5,622,366 A * 4/1997 Inoue ..... 273/138.2
5,634,639 A * 6/1997 Tokito et al. ..... 273/123 R
5,667,218 A * 9/1997 Kumabe et al. ..... 273/138.3
5,697,611 A * 12/1997 Kelly et al. ..... 273/126 A
5,713,572 A * 2/1998 Hagiwara ..... 273/138.3
5,752,699 A * 5/1998 Crompton et al. ..... 273/138.2
5,785,314 A * 7/1998 Hamano ..... 273/138.3
5,887,870 A * 3/1999 Kumabe et al. ..... 273/138.3
5,951,009 A * 9/1999 Miyamoto et al. ..... 273/121 B
6,022,020 A * 2/2000 Nishikawa ..... 273/108
6,264,197 B1 * 7/2001 Halliburton ..... 273/138.2
6,520,500 B2 * 2/2003 Pierce et al. ..... 273/108

(Continued)

FOREIGN PATENT DOCUMENTS

GB 2 226 766 A 7/1990

(Continued)

*Primary Examiner* — Gene Kim
*Assistant Examiner* — Alexander R Niconovich
(74) *Attorney, Agent, or Firm* — Oliff & Berridge, PLC

(57) ABSTRACT

A spiral rod that is rotated by a motor is disposed in a fall passage connected to a token chute 4. A second special game medium AM2 is captured at an opening W2 between the spiral rod and a rear wall positioned diagonally rearward from the spiral rod. A first special game medium AM1 is captured at an opening W1 between the spiral rod and a rear fall guide, the opening W1 being positioned on a downstream side of the opening W2. A token M passes through the openings W1 and W2 and is received by a token reception section. The special game media that have been captured are transferred due to the spiral movement of the spiral rod. The special game media are discriminated by a first rear side opening and a second rear side opening, and separately received by guide slopes.

21 Claims, 11 Drawing Sheets

U.S. PATENT DOCUMENTS

| | | | | |
|---|---|---|---|---|
| 6,550,768 | B2 * | 4/2003 | Jordan | 273/138.3 |
| 6,565,086 | B2 * | 5/2003 | Williams et al. | 273/138.1 |
| 6,629,887 | B1 * | 10/2003 | Todaiji et al. | 463/2 |
| 6,769,687 | B2 * | 8/2004 | Ohara et al. | 273/138.1 |
| 6,811,494 | B2 * | 11/2004 | Tamura et al. | 463/53 |
| 6,899,328 | B2 * | 5/2005 | Halliburton et al. | 273/138.1 |
| 7,017,904 | B2 * | 3/2006 | Ohara et al. | 273/138.1 |
| 7,172,197 | B2 * | 2/2007 | Wilson et al. | 273/288 |
| 7,192,342 | B2 * | 3/2007 | Shoemaker, Jr. | 463/7 |
| 7,267,615 | B2 * | 9/2007 | Rodden et al. | 463/30 |
| 7,537,217 | B2 * | 5/2009 | Fukazawa et al. | 273/447 |
| 7,559,552 | B2 * | 7/2009 | Shoemaker, Jr. | 273/138.3 |
| 7,722,043 | B2 * | 5/2010 | Takeuchi et al. | 273/129 R |
| 7,806,405 | B2 * | 10/2010 | Crompton | 273/121 B |
| 2002/0037771 | A1 * | 3/2002 | Tamura et al. | 463/53 |
| 2002/0175465 | A1 * | 11/2002 | Halliburton et al. | 273/138.1 |
| 2002/0180145 | A1 * | 12/2002 | Krise et al. | 273/120 A |
| 2003/0020234 | A1 * | 1/2003 | Jordan | 273/138.3 |
| 2003/0073479 | A1 * | 4/2003 | Wilson et al. | 463/16 |
| 2004/0036224 | A1 * | 2/2004 | Crompton | 273/454 |
| 2005/0046106 | A1 * | 3/2005 | Ohara et al. | 273/138.1 |
| 2005/0067779 | A1 * | 3/2005 | Hattori | 273/138.3 |
| 2005/0087926 | A1 * | 4/2005 | Hattori | 273/138.3 |
| 2005/0093227 | A1 * | 5/2005 | Sines | 273/121 B |
| 2005/0121850 | A1 * | 6/2005 | Pierce et al. | 273/139 |
| 2005/0258019 | A1 * | 11/2005 | Tiberi | 198/867.11 |
| 2006/0027973 | A1 * | 2/2006 | Nireki et al. | 273/440 |
| 2006/0249896 | A1 * | 11/2006 | Yamazaki et al. | 273/120 A |
| 2007/0126185 | A1 * | 6/2007 | Fukuzawa et al. | 273/447 |
| 2007/0200289 | A1 * | 8/2007 | Morikawa et al. | 273/120 A |
| 2007/0296146 | A1 * | 12/2007 | Omoto et al. | 273/138.3 |
| 2008/0116631 | A1 * | 5/2008 | Shoemaker | 273/138.3 |
| 2009/0160128 | A1 * | 6/2009 | Takeuchi et al. | 273/126 R |
| 2009/0163261 | A1 * | 6/2009 | Crompton | 463/5 |
| 2009/0224473 | A1 * | 9/2009 | Motegi et al. | 273/138.1 |
| 2009/0322022 | A1 * | 12/2009 | Crompton | 273/121 B |
| 2010/0044960 | A1 * | 2/2010 | Nagayama et al. | 273/138.3 |
| 2010/0096803 | A1 * | 4/2010 | Sasaki et al. | 273/138.3 |
| 2010/0160020 | A1 * | 6/2010 | Okuaki | 463/17 |
| 2010/0230895 | A1 * | 9/2010 | Okuaki | 273/138.3 |

FOREIGN PATENT DOCUMENTS

| | | | |
|---|---|---|---|
| GB | 2 446 703 | A | 8/2008 |
| GB | 2 449 402 | A | 11/2008 |
| JP | U-63-53582 | | 4/1998 |
| JP | A-2001-293252 | | 10/2001 |
| JP | A 2002-253842 | | 9/2002 |
| JP | A-2004-248690 | | 9/2004 |
| JP | A-2007-105500 | | 4/2007 |
| JP | B1-3944517 | | 7/2007 |
| WO | WO 2007/080830 | A1 | 7/2007 |
| WO | WO 2007/080832 | A1 | 7/2007 |

* cited by examiner

[SEC. VIA–VIA]

[SEC. VIB–VIB]

[SEC. VIC–VIC]

[SEC. VIB−VIB]

[SEC. VIB−VIB]

[SEC. VIA−VIA]

[SEC. VIC−VIC]

TOKEN GAME MACHINE

Japanese Patent Application No. 2007-203082 filed on Aug. 3, 2007, is hereby incorporated by reference in its entirety.

BACKGROUND OF THE INVENTION

The present invention relates to a token game machine that implements a game using a token as a game medium.

A pusher-type token game machine has been known. The pusher-type token game machine includes a stationary table having a front end that extends over a token chute, and a pusher table that slides forward and backward with respect to the token chute along the upper side of the stationary table through an insertion hole (entrance) formed at the rear of the stationary table, the stationary table and the pusher table being provided in a game space. A number of tokens are placed on the upper side of the stationary table and the upper side of the pusher table. An opening between the upper side of the stationary table and the lower side of the pusher table is set to be smaller than the thickness of the token so that the token placed on the stationary table can be pushed by the front face of the pusher table.

When the player has inserted tokens into the game machine, tokens in the same number as the number of the inserted tokens are supplied to the game space and are placed on the upper side of the pusher table. When the pusher table moves backward while sliding along the stationary table, the pusher table is withdrawn into the insertion hole (entrance). When the pusher table is withdrawn into the insertion hole, the tokens placed at the rear of the upper side of the pusher table contact the edge of the insertion hole and are pushed relatively forward. This causes other tokens placed on the pusher table to be pushed forward one after the other so that the tokens positioned on the front end of the pusher table fall onto a space formed on the upper side of the stationary table due to the backward movement of the pusher table. When the pusher table slides forward on the stationary table, the token which has fallen onto the stationary table is pushed forward by the front face of the pusher table. The tokens which have been placed on the upper side of the stationary table are then pushed forward one after the other. Some of the tokens which have been placed on the upper side of the stationary table fall into the token chute from the front end of the stationary table, and the tokens which have fallen are discharged from the token discharge port. The player enjoys playing the game by determining an appropriate token placement position that discharges a larger number of tokens.

In recent years, a token game machine in which a ball is supplied to the stationary table as a game medium differing from the token has been known (see JP-A-2002-253842, for example). In such a token game machine using a special game medium, when a ball supplied to the stationary table is moved together with the tokens placed on the stationary table and falls into the token chute, the ball is sorted out from the tokens, transferred to a lottery device by a recover mechanism and a transfer mechanism, and used as a lottery medium. The above-described technology implements an interesting token game by enabling a visual change due to the addition of a ball as a special game medium and using the ball as a lottery medium.

In a related-art token game machine, only one type of special game medium is placed on the stationary table, the pusher table, or the like together with a token. Therefore, a visual effect and a lottery process utilizing the special game medium are limited.

SUMMARY

According to one aspect of the invention, there is provided a token game machine comprising:

a token placement section; a token, a first special game medium, and a second special game medium that is larger than the first special game medium being placed on the token placement section, a token chute;

a pusher section that pushes an object placed on the token placement section;

a capture/transfer section that captures the first special game medium and the second special game medium that have fallen into the token chute and transfers the first special game medium and the second special game medium to a given transfer destination; and a reception section that discriminatingly receives the first special game medium and the second special game medium transferred from the capture/transfer section.

According to another aspect of the invention, there is provided a token game machine comprising:

a token placement section; a token, a first special game medium, and a second special game medium that is larger than the first special game medium being placed on the token placement section, a token chute;

a pusher section that pushes an object placed on the token placement section;

a capture/transfer section that captures the first special game medium and the second special game medium that have fallen into the token chute and transfers the first special game medium and the second special game medium to a given transfer destination;

a reception section that receives one of the first special game medium and the second special game medium transferred from the capture/transfer section; and a special game medium discharge section that discharges the other of the first special game medium and the second special game medium transferred from the capture/transfer section.

DETAILED DESCRIPTION OF THE EMBODIMENT

Figure 1:
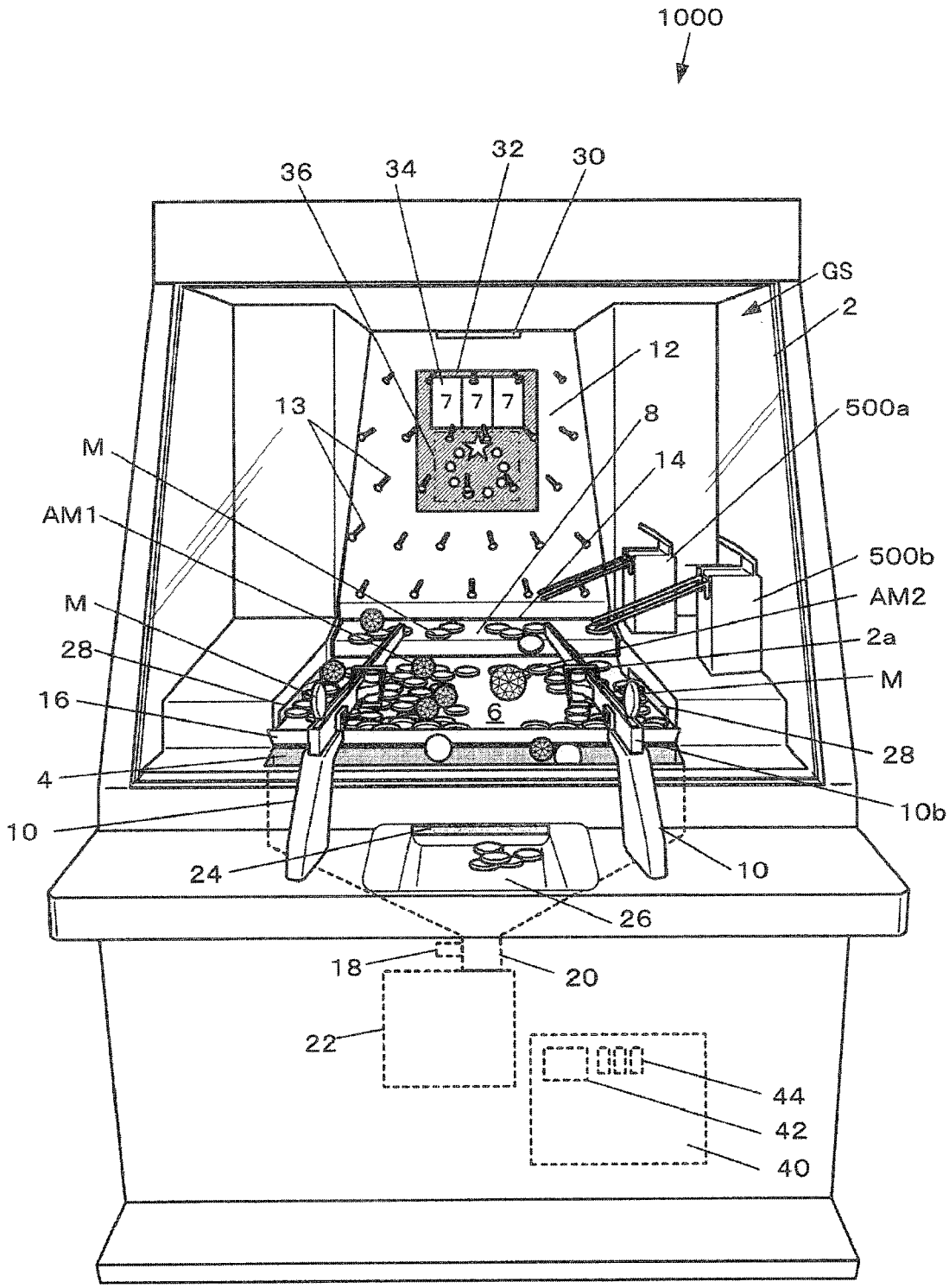
FIG. 1 is a front external view showing an example of the configuration of a token game machine.

The invention may increase the number of special game media which can be used in a token game machine using a special game medium which is a game medium differing from a token to improve game playability.

According to one embodiment of the invention, there is provided a token game machine comprising:

a token placement section; a token, a first special game medium, and a second special game medium that is larger than the first special game medium being placed on the token placement section, a token chute;

a pusher section that pushes an object placed on the token placement section;

a capture/transfer section that captures the first special game medium and the second special game medium that have fallen into the token chute and transfers the first special game medium and the second special game medium to a given transfer destination; and a reception section that discriminatingly receives the first special game medium and the second special game medium transferred from the capture/transfer section.

According to this configuration, the first special game medium and the second special game medium that have fallen into the token chute can be selectively captured, transferred to a given transfer destination, and discriminatingly received. If the first special game medium and the second special game medium can be discriminatingly received, the special game medium that has been stored can be supplied (circulated) to the game space, or discharged to the player. Therefore, even if a plurality of types of special game media are used while utilizing one token chute, the special game media can be sorted and utilized for a lottery or discharge, whereby game playability can be improved.

In the token game machine, the reception section may include:

a first reception section that receives the first special game medium that has passed through a first entrance, the first entrance having a size that allows the first special game medium to pass through, but does not allow the second special game medium to pass through; and a second reception section that receives the second special game medium that has passed through a second entrance, the second entrance having a size that allows the second special game medium to pass through; and the first entrance may be disposed on an upstream side as compared with the second entrance along a transfer path of the capture/transfer section.

This enables the first special game medium and the second special game medium to be discriminated by a simple structure. Therefore, a structure required to discriminate the special game media can be simplified even when using a plurality of types of special game media, whereby an increase in the size of the machine can be suppressed.

According to another embodiment of the invention, there is provided a token game machine comprising:

a token placement section; a token, a first special game medium, and a second special game medium that is larger than the first special game medium being placed on the token placement section, a token chute;

a pusher section that pushes an object placed on the token placement section;

a capture/transfer section that captures the first special game medium and the second special game medium that have fallen into the token chute and transfers the first special game medium and the second special game medium to a given transfer destination;

a reception section that receives one of the first special game medium and the second special game medium transferred from the capture/transfer section; and a special game medium discharge section that discharges the other of the first special game medium and the second special game medium transferred from the capture/transfer section.

According to this configuration, the first special game medium and the second special game medium that have fallen into the token chute can be selectively captured and transferred to a given transfer destination, and one of the first special game medium and the second special game medium can be stored while the other of the first special game medium and the second special game medium can be discharged to the player. Therefore, even if a plurality of types of special game media are used while utilizing one token chute, the special game media can be sorted and utilized for a lottery or discharge, whereby game playability can be improved.

In the token game machine, the capture/transfer section may include a spiral transfer mechanism having a spiral section disposed along a given transfer path, an opening that allows the token to pass through, but does not allow the first special game medium to pass through being formed between the spiral transfer mechanism and an inner wall of a fall passage for the token that has fallen into the token chute.

In the token game machine, the token game machine may further include a guide section provided along a transfer path of the capture/transfer section, the guide section coming in contact with the first special game medium and the second special game medium that have fallen into the token chute, the capture/transfer section may include a spiral transfer mechanism having a spiral section disposed along a given transfer path, an opening that allows the token to pass through, but does not allow the first special game medium to pass through being formed between the spiral transfer mechanism and the guide section.

This enables the first special game medium and the second special game medium larger than the first special game medium to be captured, moved, and transferred by the spiral transfer mechanism. Specifically, since the spiral transfer mechanism can be utilized as a capture/sort structure in addition to the transfer structure, the capture/transfer structure of the special game medium can be simplified and the number of parts can be reduced.

In the token game machine, the spiral section may include a shaft and a spiral member spirally provided around the shaft, the first special game medium and the second special game medium may be rolled and transferred by the spiral member due to rotation of the spiral section.

This enables a spiral section to be formed by a simple structure.

In the token game machine, the spiral section may be configured so that the spiral member and the shaft allow only one first game medium or second special game medium to be positioned within one spiral pitch.

According to the above configuration, one spiral pitch engages one special game medium so that the special game medium can be moved. In the case where two or more special game media are positioned corresponding to one pitch, when the special game media are moved due to spiral movement, since two adjacent special game media are rotated reversely, one of the special game media may be repelled so that clogging may occur. However, when one special game medium is positioned corresponding to one pitch, smooth and reliable transfer can be implemented by preventing clogging.

In the token game machine, the capture/transfer section may include a belt transfer mechanism having a belt transfer side, the belt transfer side and an inner wall of a fall passage for the token being positioned to have an opening that allows the token to pass through, but does not allow the first special game medium to pass through.

In the token game machine, the token game machine may further include a guide section provided along a transfer path of the capture/transfer section, the guide section coming in contact with the first special game medium and the second special game medium that have fallen into the token chute, the capture/transfer section may include a belt transfer mechanism having a belt transfer side, the belt transfer side and the guide section being positioned to have an opening that allows the token to pass through, but does not allow the first special game medium to pass through.

According to this configuration, the first special game medium and the second special game medium larger than the first special game medium can be captured and transferred by the belt transfer mechanism. Specifically, since the belt transfer mechanism can be utilized as a capture/sort structure in addition to the transfer structure, the structure can be simplified and the number of parts can be reduced.

In the token game machine, depressions may be successively formed in the belt transfer side, each of the depressions being capable of receiving only one first special game medium or second special game medium.

According to this configuration, since the first special game medium or the second special game medium achieves engagement within one depression, reliable transfer without clogging can be implemented. In the case where two or more special game media are positioned corresponding to one depression, when the special game media are moved due to spiral movement, two adjacent special game media are rotated reversely. Therefore, one of the special game media may be repelled so that clogging may occur. However, since one special game medium is positioned with respect to one depression, a smooth transfer without clogging can be implemented.

Embodiments of the invention are described below with reference to the drawings. Note that the following embodiments do not in any way limit the scope of the invention defined by the claims laid out herein. Note that all elements of the following embodiments should not necessarily be taken as essential requirements for the invention.

First Embodiment

A first embodiment to which the invention is applied is described below with reference to the drawings. This embodiment illustrates an example of a pusher-type token game machine using a metal token as a game medium.

Configuration of Machine

FIG. 1 is a front external view showing an example of the configuration of a token game machine 1000 according to this embodiment. As shown in FIG. 1, the token game machine 1000 according to this embodiment has a game space GS enclosed by a transparent cover glass 2, and includes a stationary table 6 having a front end which extends upward over a token chute 4, and a pusher table 8 which cyclically reciprocates along the upper side of the stationary table 6, the stationary table 6 and the pusher table 8 being provided in the game space GS. The token game machine 1000 has a basic configuration classified as a pusher-type token game machine. A manager of the token game machine 1000 or the like places a number of tokens M on the upper side of the stationary table 6 and the upper side of the pusher table 8 in advance.

In the following description, the terms "vertical direction", "right and left direction", and "back and forth direction" respectively refer to the vertical direction, the right and left direction, and the back and forth direction with respect to the token game machine 1000. Specifically, the terms "forward direction" and "backward direction" respectively refer to the forward direction and the backward direction with respect to the token game machine 1000. The direction toward the token chute 4 with respect to the stationary table 6 is referred to as the forward direction, and the direction opposite to the direction toward the token chute 4 with respect to the stationary table 6 is referred to as the backward direction.

The player inserts a token M into a token insertion device 10 to start a game. The token insertion device 10 includes a guide section 10*b* having a groove which opens upward and into which the token M can be inserted in an upright state. The guide section 10*b* is inserted into a guide insertion slot 2*a* formed in the transparent cover glass 2, and is supported by a hinge mechanism so that the guide section 10*b* can be moved horizontally within a given angular range. The end of the guide section 10*b* is positioned over the front side of the pusher table 8. Therefore, the token M inserted into the guide section 10*b* of the token insertion device 10 by the player rolls in the groove of the guide section 10*b*, is guided to (inserted into) the game space GS, and falls onto (is placed on) the upper side of the pusher table 8.

The pusher table 8 is a plate-like member which is slidably placed on the stationary table 6 and on which the token M can be placed. The pusher table 8 is cyclically reciprocated in the back and forth direction by a reciprocation mechanism (not shown) provided on the back side of a game board 12, and moves forward and backward through a horizontal insertion hole 14 (entrance) provided at the lower end of the game board 12.

When the pusher table 8 has slid backward on the stationary table 6, the tokens M placed on the upper side of the pusher table 8 move backward together with the pusher table 8. When the pusher table 8 is withdrawn into the insertion hole 14, the length of the pusher table 8 extending from the insertion hole 14 is reduced by the amount of the backward movement. Therefore, the tokens placed at the rear of the upper side of the pusher table 8 come into contact with the periphery of the insertion hole 28 and are pushed relatively forward. This causes other tokens placed on the pusher table 8 to be pushed forward one after the other so that the tokens M positioned on the front end of the pusher table 8 fall onto the stationary table 6.

The front end face of the pusher table 8 pushes the tokens M that have fallen onto the upper side of the stationary table 6 and are placed on the stationary table 6 along with the forward movement so that the tokens M move forward. This causes the tokens placed on the stationary table 6 to be pushed forward one after the other.

The front end of the stationary table 6 has a slope portion 16 that inclines upward over the token chute 4. The tokens pushed forward by the pusher table 8 move upward along the slope portion 16. The tokens M incline with respect to the upper side of the stationary table 6 when moving upward along the slope portion 16. When the tokens M are pushed further forward, the tokens M move beyond the slope portion 16 and fall into the token chute 4.

The token chute 4 corresponds to the upper opening of a funnel-shaped fall passage of which the lower end communicates with a passage 20. The tokens M that have fallen into the token chute 4 are detected by a token sensor 18 provided under the fall passage, and enter the token reception section 22 through the passage 20. The tokens received by the token reception section 22 are transferred to an acquired token discharge port 24 by a transfer mechanism (not shown), and tokens in a number equal to the number of tokens M detected by the token sensor 18 are discharged to a token tray 26.

The stationary table 6 is formed so that the width of the front end is larger than the width of the pusher table 8. The stationary table 6 is shaped so that the width of the stationary table 6 increases as the distance from the forward movement limit position of the pusher table 8 increases. A side token chute 28 that receives only the tokens M is provided in each sidewall positioned in the area in which the width of the stationary table 6 increases. The tokens M that have fallen into the side token chute 11 enter the token reception section 22 through an internal passage, but are not discharged to the token tray 26.

The token game machine 1000 according to this embodiment has a lottery function. When the player has won a special bonus by lottery, a given number of tokens are discharged from a special discharge port 30 as a bonus. The discharged tokens move downward while hitting nails 13 that protrude from the game board 12, and are placed on the pusher table 8. In this embodiment, a first special game medium AM1 and a second special game medium AM2 are used to determine the lottery execution timing. This embodiment utilizes two types of special game media (first special game medium AM1 and second special game medium AM2). The first special game medium AM1 and the second special game medium AM2 have an external shape differing from that of the token M as the game medium. The second special game medium AM2 is larger than the first special game medium AM1. The first special game medium AM1 and the second special game medium AM2 differ in color.

Figure 2A:
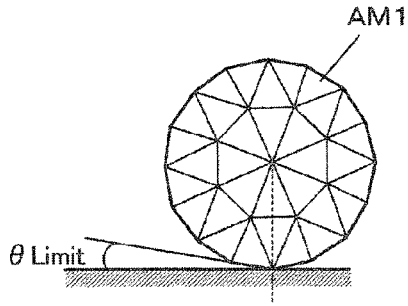
FIGS. 2A to 2C are schematic views illustrative of the external shape of a special game medium.
Figure 2B:
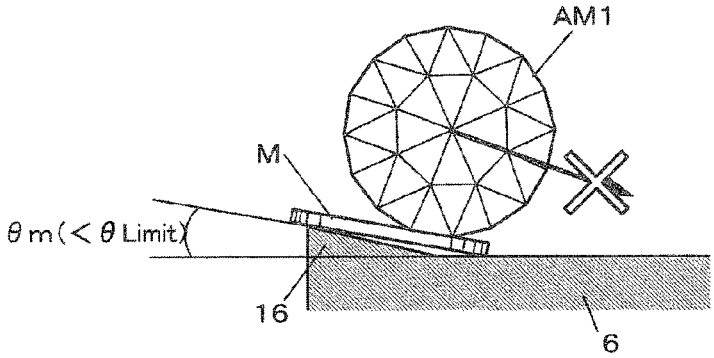
Figure 2C:
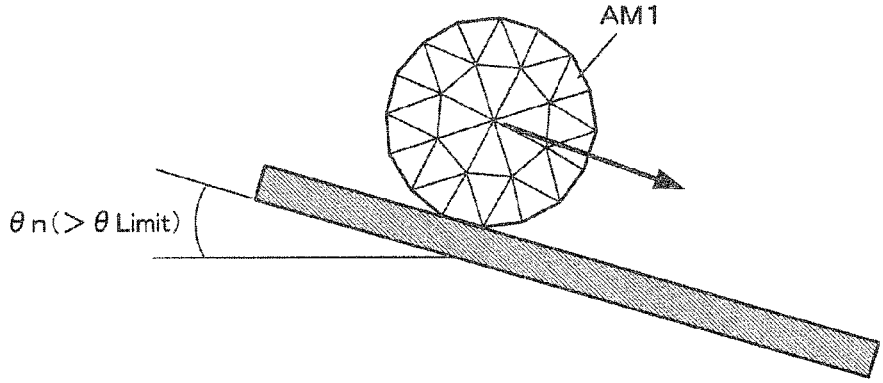

The external shape of the first special game medium AM1 is described below as a representative of the first special game medium AM1 and the second special game medium AM2. FIG. 2A to 2C are views showing the external shape of the first special game medium AM1 according to this embodiment. As shown in FIG. 2A, the first special game medium AM1 is an almost spherical polyhedron formed of an optically transparent synthetic resin. The first special game medium AM1 is a rolling element that spontaneously rolls on an inclined surface. The total height (corresponding to the diameter in this case) of the first special game medium AM1 is equal to or greater than a value twice the thickness of the token M.

The entire rolling surface of the first special game medium AM1 according to this embodiment is covered with a number of triangular flat surfaces. The triangular flat surface is formed so that the first special game medium AM1 does not start rolling due to its weight when placed on a slope in an angle range from zero (horizontal) to a stationary limit angle θLimit and maintains a stationary state. Specifically, the angle range from zero (horizontal) to the stationary limit angle θLimit is a non-rolling slope angle range in which the first special game medium AM1 does not roll spontaneously.

In this embodiment, as shown in FIG. 2B, the stationary limit angle θLimit is set to be larger than an inclination angle θm by which the token M is inclined due to the slope portion 16 of the stationary table 6. Specifically, the stationary limit angle θLimit is set so that the first special game medium AM1 does not roll spontaneously even when the first special game medium AM1 is placed on the tokens accumulated on the slope portion 16. As shown in FIG. 2C, when the surface on which the first special game medium AM1 is placed inclines by an angle θn which is larger than the stationary limit angle θLimit, the first special game medium AM1 rolls spontaneously and moves downward along the slope.

As shown in FIG. 1, the token game machine 1000 according to this embodiment is configured so that a first lifter 500*a* lifts the first special game medium AM1 to the game space GS, and discharges the first special game medium AM1 onto the upper side of the pusher table 8. A second lifter 500*b* lifts the second special game medium AM2 to the game space GS, and discharges the second special game medium AM2 onto the upper side of the stationary table 6.

The operations of the first lifter 500*a* and the second lifter 500*b* are controlled by a control unit 40. The number of special game media discharged is controlled so that a plurality of (e.g., five to seven) first special game media AM1 are necessarily placed on the stationary table 6 and the pusher table 8. The number of special game media discharged is controlled so that a small number of (e.g., one or two) second special game media AM2 are necessarily placed on the stationary table 6 and the pusher table 8.

The first special game medium AM1 discharged from the first lifter 500*a* is directly placed on the upper side of the pusher table 8, or is placed on the token M placed on the upper side of the pusher table 8. The first special game medium AM1 is pushed and falls onto the stationary table 6 due to the forward and backward movement of the pusher table 8. Likewise, the second special game medium AM2 discharged from the second lifter 500*b* is directly placed on the upper side of the stationary table 6, or is placed on the token M placed on the upper side of the stationary table 6.

The first special game medium AM1 placed on the pusher table 8 moves together with the tokens M placed on the pusher table 8 along with the forward and backward movement of the pusher table 8. The first special game medium AM1 and the second special game medium AM2 placed on the stationary table 6 move together with the tokens M toward the token chute 4. When the first special game medium AM1 and the second special game medium AM2 have fallen into the token chute 4, the first special game medium AM1 and the second special game medium AM2 which have fallen are detected, and a control unit 50 then executes a lottery process.

The control unit 40 includes electronic/electric components such as a central processing unit (CPU) 42 and an IC memory 44. The CPU 42 executes various calculation processes according to a program stored in the IC memory 44 to control each section of the token game machine 1000.

The control unit 40 executes a first lottery process and a second lottery process as a privilege granting process according to this embodiment.

The first lottery process is a first privilege granting process that is executed on condition that the first special game medium AM1 which has fallen into the token chute 4 has been detected. The control unit 40 causes a liquid crystal display 32 provided in the game board 12 to display a screen in which a virtual slot machine 34 operates, and display symbols corresponding to the lottery result. For example, when the player has won a special bonus as a result of lottery, the control unit 40 causes the liquid crystal display 32 to display three identical symbols (e.g., "777"). When the player has won a special bonus, a given number of tokens M are discharged from the special discharge port 30 onto the upper side of the pusher table 8 as a bonus.

The second lottery process is a second privilege granting process that is executed on condition that the second special game medium AM2 which has fallen into the token chute 4 has been detected. For example, the control unit 40 causes the liquid crystal display 32 to display a roulette 36, and display the start of roulette and the roulette result corresponding to the lottery result. In the example shown in FIG. 1, the roulette 36 is formed of small circular marks and a star mark displayed circularly. The control unit 40 causes the liquid crystal display 32 to display a roulette 36 so that one of the marks emits light when the roulette starts. The control unit 40 controls the display so that the light-on position moves clockwise until the roulette stops and the light-on position stops at a position corresponding to the lottery result. When the player has won a bonus in the second lottery process, the light-on position stops at the position of the star mark so that the game mode transitions to a probability change state (probability change mode) in which the probability that the player wins the first lottery is temporarily increased. If the player can cause the first special game medium AM1 to fall into the token chute 4 in the probability change mode, the player can win a bonus with high probability in the first lottery process.

Circulation Mechanism

The first special game medium AM1 and the second special game medium AM2 which have fallen into the token chute 4 are caught and sorted corresponding to the type in the fall passage connected to the token chute 4, and are transferred to the first lifter 500*a* and the second lifter 500*b*, respectively.

Figure 3:
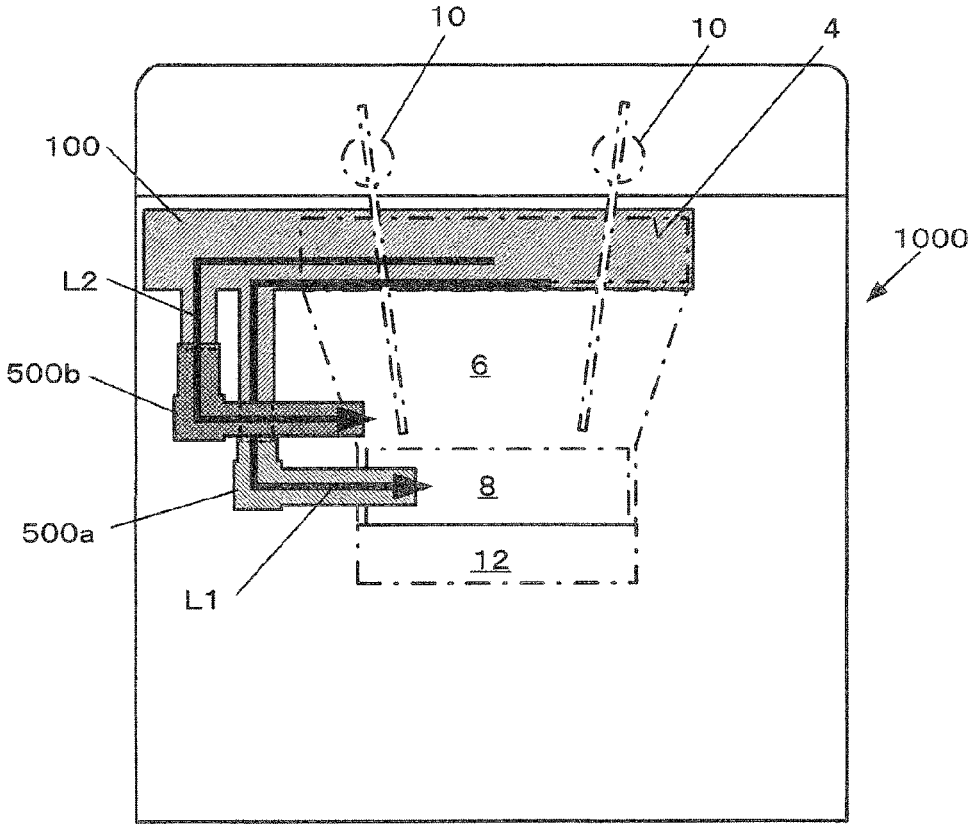
FIG. 3 is a perspective top layout diagram illustrative of an outline of a circulation mechanism for a first special game medium and a second special game medium.

FIG. 3 is a top perspective layout diagram illustrative of an outline of the circulation mechanism for the first special game medium AM1 and the second special game medium AM2 according to this embodiment. In FIG. 3, the upper side corresponds to the front side of the machine, and the lower side corresponds to the rear side of the machine. As shown in FIG. 3, the token game machine 1000 includes a sort/discharge section 100, the first lifter 500*a*, and the second lifter 500*b* as components of the circulation mechanism.

The sort/discharge section 100 sorts the tokens M and the special game media which have fallen into the token chute 4. The sort/discharge section 100 selectively captures and transfers the first special game medium AM1 and the second special game medium AM2 to store given numbers of first special game media AM1 and second special game media AM2. The first special game medium AM1 and the second special game medium AM2 stored in the sort/discharge section 100 are discharged to the first lifter 500*a* or the second lifter 500*b* in a first-in, first-out manner as the first special game medium AM1 and the second special game medium AM2 are further captured and stored.

The first lifter 500*a* lifts the first special game medium AM1 discharged from the sort/discharge section 100 to the game space GS, and discharges the first special game medium AM1.

The second lifter 500*b* lifts the second special game medium AM2 discharged from the sort/discharge section 100 to the game space GS, and discharges the second special game medium AM2.

The details of the sort/discharge section 100 are given below.

Figure 4:
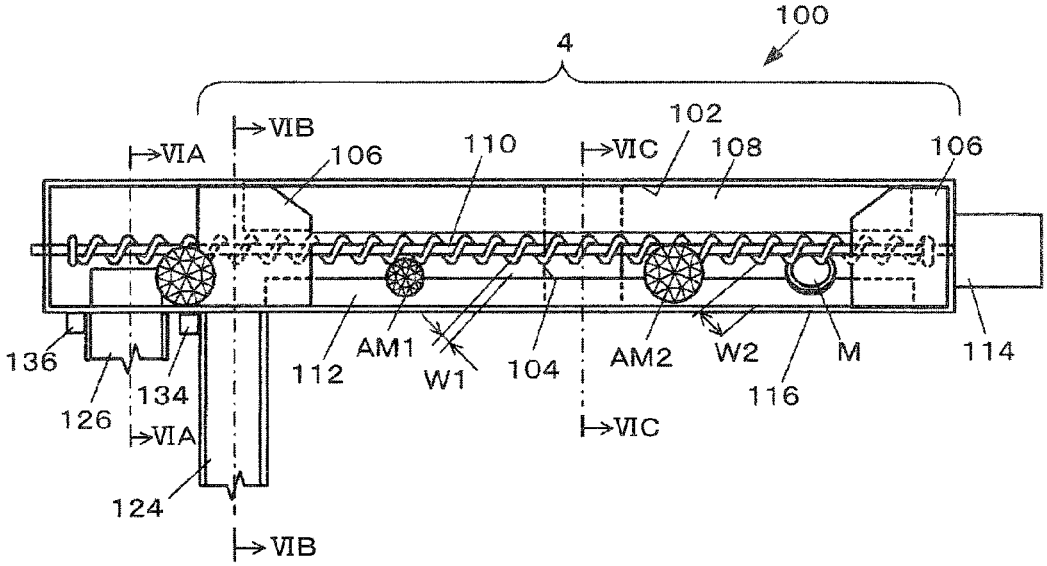
FIG. 4 is a top view showing a sort/discharge section according to a first embodiment.
Figure 5:
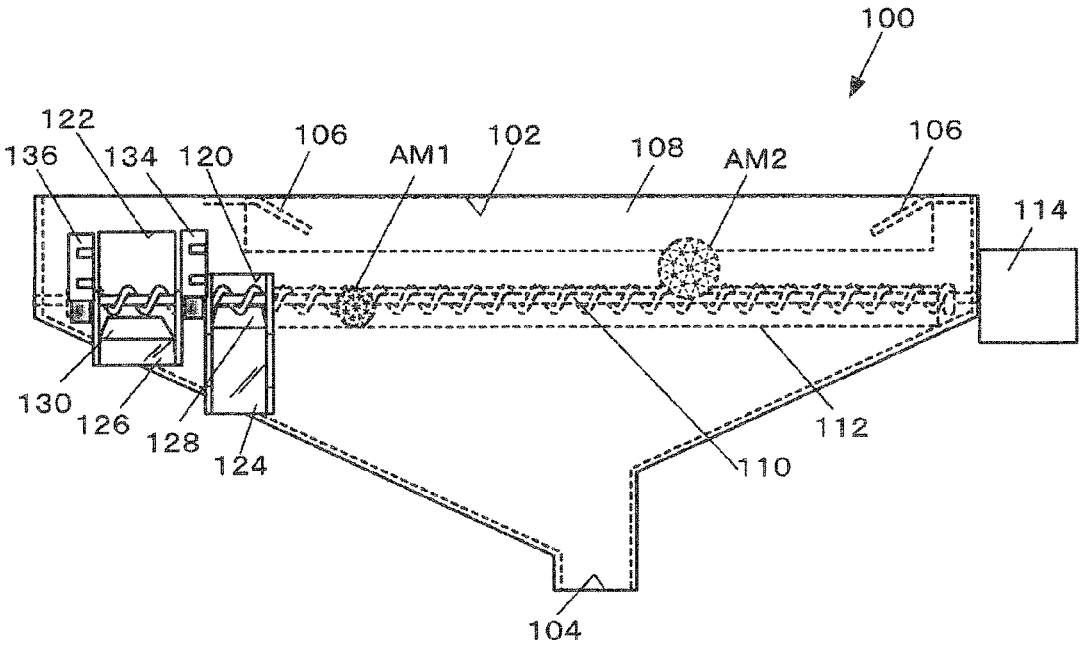
FIG. 5 is a rear side view showing the sort/discharge section according to the first embodiment.
Figure 6A:
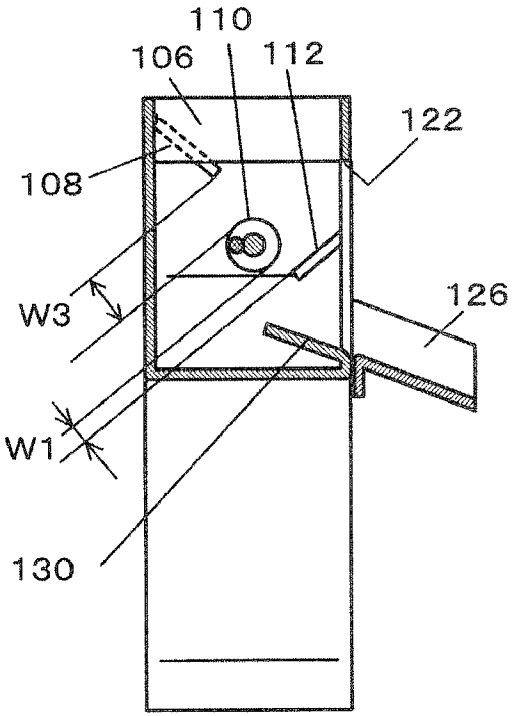
FIG. 6A is a vertical cross-sectional view along the line VIA-VIA shown in FIG. 4.
Figure 6B:
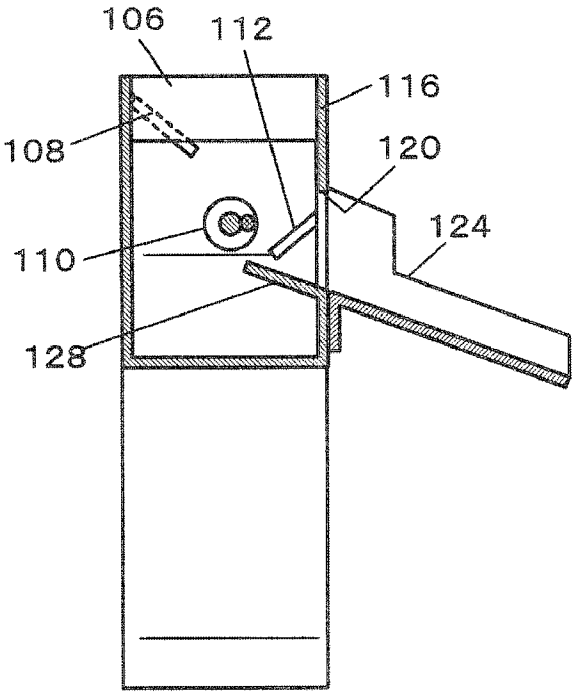
FIG. 6B is a vertical cross-sectional view along the line VIB-VIB shown in FIG. 4.
Figure 6C:
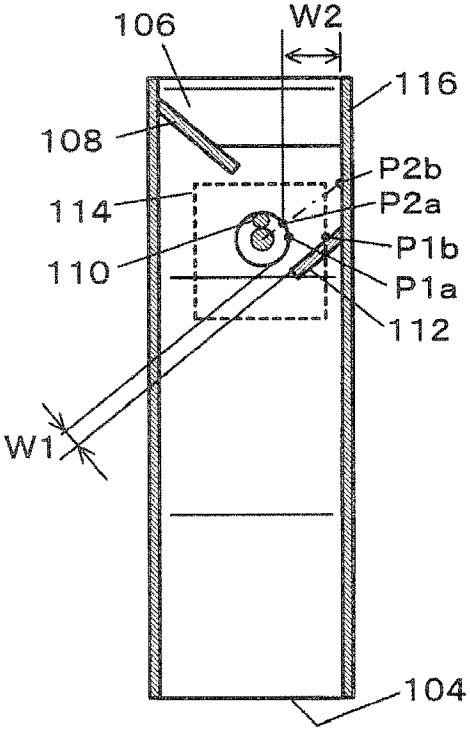
FIG. 6C is a vertical cross-sectional view along the line VIC-VIC shown in FIG. 4.

FIG. 4 is a top view showing the sort/discharge section 100 according to this embodiment, and FIG. 5 is a rear side view showing the sort/discharge section 100 from the rear side. FIG. 6A is a vertical cross-sectional view along the line VIA-VIA shown in FIG. 4, FIG. 6B is a vertical cross-sectional view along the line VIB-VIB shown in FIG. 4, and FIG. 6C is a vertical cross-sectional view along the line VIC-VIC shown in FIG. 4.

As shown in FIGS. 4 and 5, the sort/discharge section 100 is a funnel-shaped member having a rectangular (oblong) horizontal cross section. The right portion of an upper opening 102 of the funnel-shaped body corresponds to the token chute 4, and a lower opening 104 is connected to the passage 20 that is connected to the token reception section 22. Specifically, a portion from the right portion of the upper opening 102 to the lower opening 104 forms the fall passage connected to the token chute 4.

A side fall guide 106 that inwardly guides an object which has fallen into the token chute 4 is provided on each end of the portion of the sort/discharge section 100 corresponding to the token chute 4. A front fall guide 108 that forms a slope which inclines downward is provided on the front inner wall of the portion of the sort/discharge section 100 corresponding to the token chute 4. The front fall guide 108 guides an object which has fallen into the token chute 4 rearward. A spiral rod 110 and a rear fall guide 112 are provided at a position diagonally downward and rearward from the front fall guide 108 (i.e., a position where an object which has fallen into the token chute 4 is guided by the front fall guide 108).

The spiral rod 110 is a rod member having a spiral shape. The spiral rod 110 is disposed along the longitudinal direction of the sort/discharge section 100 (i.e., the longitudinal direction of the token chute 4), and is pivotally supported by the right and left walls of the sort/discharge section 100. The right end of the spiral rod 110 passes through the wall of the sort/discharge section 100 and is connected to a rotary shaft of a motor 114 secured on the outer wall of the sort/discharge section 100.

Figure 7:
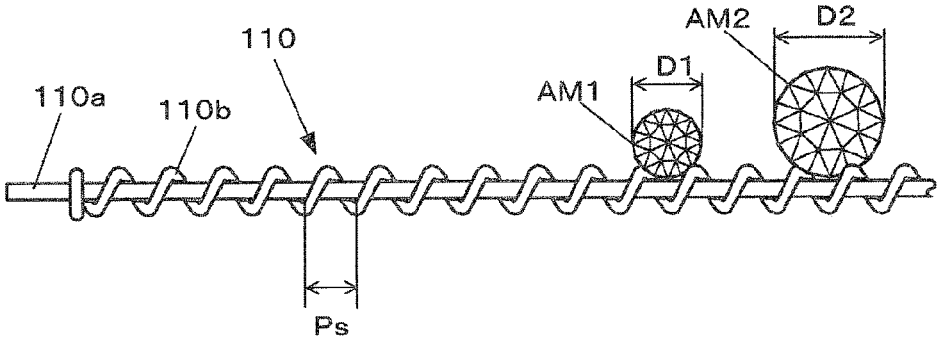
FIG. 7 is a view showing a configuration example of a spiral rod.

As shown in FIG. 7, a wire 110*b* is spirally wound clockwise (clockwise with respect to the axial direction) around the periphery of a center shaft 110*a* of the spiral rod 110 (spiral section) according to this embodiment at a given pitch. A winding pitch (spiral pitch) Ps of the wire 110*b* is set to be smaller than a diameter D1 of the first special game medium AM1 and a diameter D2 of the second special game medium AM2 so that only one first special game medium AM1 or second special game medium AM2 can be supported by the wire 110*b* corresponding to one pitch. Specifically, one first special game medium AM1 or one second special game medium AM2 is supported by the wire 110*b* corresponding to one pitch.

Figure 8A:
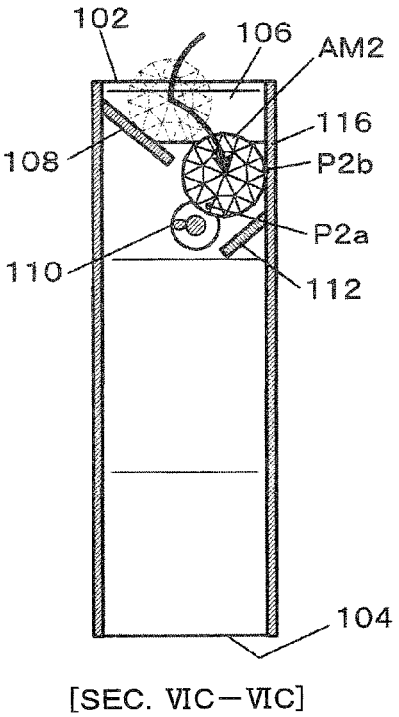
FIGS. 8A and 8B are vertical cross-sectional views showing a state in which a first special game medium and a second special game medium are captured according to the first embodiment.

As shown in FIGS. 4 and 6, the sort/discharge section 100 according to this embodiment is configured so that an opening W2 between the spiral rod 110 and the inner side of a rear wall 116 that does not interfere with the rear fall guide 112 is larger than the thickness of the token M and the diameter D1 of the first special game medium AM1, but is smaller than the diameter D2 of the second special game medium AM2. An opening W3 between the lower end of the front fall guide 108 and the spiral rod 110 is set so that the token M can pass through the opening W3, but the first special game medium AM1 and the second special game medium AM2 cannot pass through the opening W3. Therefore, the token M that has fallen through the upper opening 102 (token chute 4) falls through the opening W2, but the second special game medium AM2 is caught and supported at a contact position P2*a* with the spiral rod 110 and a contact position P2*b* with the inner side of the rear wall 116 (i.e., the second special game medium AM2 does not fall through the opening W2) (see FIG. 8A).

Figure 8B:
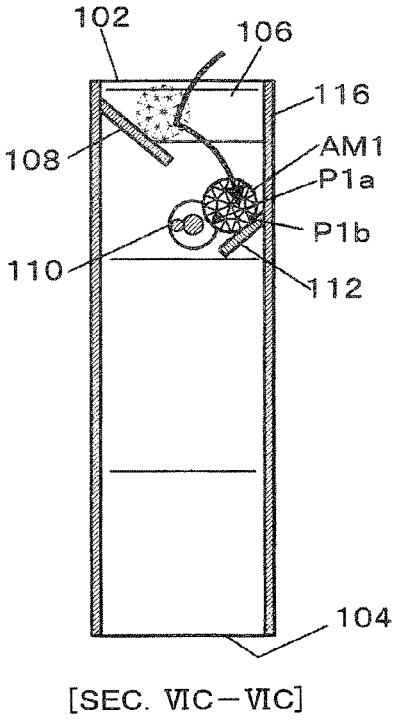

The sort/discharge section 100 includes the rear fall guide 112 that forms a forward slope along the longitudinal direction of the spiral rod 110 and is provided on the inner side of the rear wall at a position lower than the spiral rod 110. A minimum opening W1 between the rear fall guide 112 and the spiral rod 110 is set to be larger than the thickness of the token M, but is smaller than the diameter D1 of the first special game medium AM1. Therefore, the token M that has passed through the opening W2 falls through the opening W1 and reaches the lower opening 104. The first special game medium AM1 passes through the opening W2, but is caught and supported at a contact position P1*a* with the spiral rod 110 and a contact position P1*b* with the rear wall 116 (i.e., the first special game medium AM1 does not fall through the opening W1) (see FIG. 8B). Specifically, the sort/discharge section 100 sorts the token M, the first special game medium AM1, and the second special game medium AM2 that have fallen into the token chute 4.

The second special game medium AM2 captured at the opening W2 between the spiral rod 110 and the rear wall 116 and the first special game medium AM1 captured at the opening W1 between the spiral rod 110 and the rear fall guide 112 respectively engage and are supported by the wire 110*b* corresponding to one pitch. The spiral rod 110 is rotated around the axis by the motor 114 clockwise with respect to the axial direction. Therefore, the first special game medium AM1 and the second special game medium AM2 which have been captured are transferred by the spiral rod 110 to the left portion of the sort/discharge section 100 along a linear transfer path (from right to left).

As shown in FIGS. 4 to 6, a first rear side opening 120 and a second rear side opening 122 are formed in the rear wall 116 positioned in the left portion of the sort/discharge section 100 in this order from the upstream side (right in FIGS. 4 and 5) in the transfer direction at positions on the side of the spiral rod 110. The first rear side opening 120 and the second rear side opening 122 are respectively connected to gutter-shaped guide slopes 124 and 126 that incline rearward.

Each of the guide slopes 124 and 126 has a length that can accommodate a given number of first special game media AM1 or second special game media AM2. The inclination angle of the slope is set to be larger than the stationary limit angle θLimit of the first special game medium AM1 and the second special game medium AM2. The guide slope 124 is connected to the first lifter 500*a*, and the guide slope 126 is connected to the second lifter 500*b*.

The first rear side opening 120 has a shape that allows the first special game medium AM1 to pass through. The upper end of the first rear side opening 120 is positioned higher than the contact position P1*b* of the first special game medium AM1 and the rear fall guide 112, but is positioned lower than the contact position P2*b* of the second special game medium AM2 and the rear wall 116. The left end of the rear fall guide 112 reaches the right end of the first rear side opening 120. Specifically, the rear fall guide 112 ends at the right end of the first rear side opening 120.

Figure 9A:
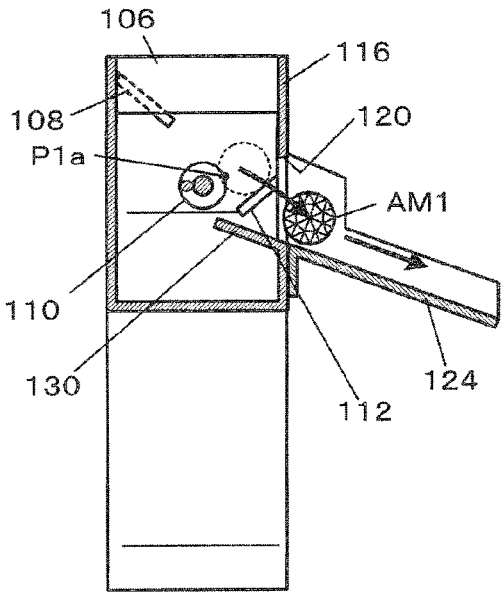
FIGS. 9A and 9B are vertical cross-sectional views showing a state in which the first special game medium is discriminated according to the first embodiment.

Therefore, when the first special game medium AM1 transferred due to the axial rotation of the spiral rod 110 has reached the position of the first rear side opening 120, the contact position P1*b* with the rear fall guide 112 is removed so that the first special game medium AM1 rolls down into the guide slope 124. An extension piece 128 that projects from a position near the lower end of the first rear side opening 120 toward the lower side of the spiral rod 110 extends the guide slope 124 forward so that the first special game medium AM1 that rolls down into the guide slope 124 is more reliably guided to the guide slope 124 (FIG. 9A).

Figure 9B:
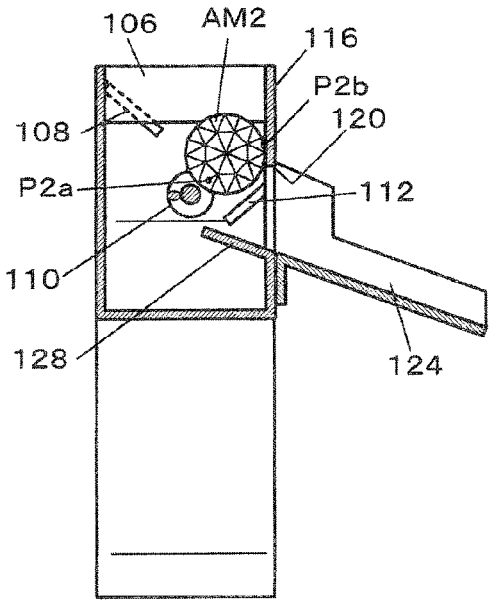

On the other hand, when the second special game medium AM2 transferred due to the axial rotation of the spiral rod 110 has reached the position of the first rear side opening 120, the second special game medium AM2 is still supported at the contact position P2*a* with the spiral rod 110 and the contact position P2*b* with the rear wall 116, and is further transferred leftward in the sort/discharge section 100 through the first rear side opening 120 (FIG. 9B).

Figure 10:
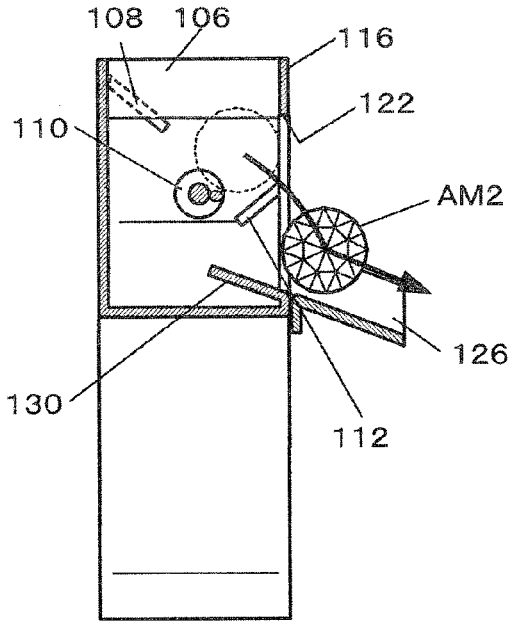
FIG. 10 is a vertical cross-sectional view showing a state in which the second special game medium is discriminated according to the first embodiment.

The second rear side opening 122 has a shape that allows the second special game medium AM2 to pass through. The upper end of the second rear side opening 122 is positioned higher than the contact position P2*b* of the second special game medium AM2 and the rear wall 116. Therefore, when the second special game medium AM2 transferred due to the axial rotation of the spiral rod 110 has reached the position of the second rear side opening 122, the rear wall 116 does not support the second special game medium AM2 so that the second special game medium AM2 rolls down into the guide slope 126. An extension piece 130 that projects from a position near the lower end of the second rear side opening 122 toward a position under the spiral rod 110 extends the guide slope 126 forward so that the second special game medium AM2 that rolls down into the guide slope 126 is more reliably guided to the guide slope 126 (FIG. 10).

Therefore, the sort/discharge section 100 according to this embodiment can sort the token M from objects that have fallen into the token chute 4 and guides the token M to the passage 20. Moreover, the first special game medium AM1 and the second special game medium AM2 can be selectively captured by utilizing the opening W1 between the spiral rod 110 and the rear wall 116 and the opening W2 between the spiral rod 110 and the rear fall guide 112.

The sort/discharge section 100 according to this embodiment can transfer the first special game medium AM1 and the second special game medium AM2 captured by the spiral rod 110 rotated by the motor 114 to a discrimination section including the first rear side opening 120 and the second rear side opening 122. Since the discrimination section is configured so that the first rear side opening 120 and the second rear side opening 122 have the above-mentioned shapes and positions and the first rear side opening 120 is disposed on the upstream side of the transfer path, the first special game medium AM1 and the second special game medium AM2 transferred by the spiral rod 110 are selectively distributed to the guide slopes 124 and 126 corresponding to the type.

The guide slope 124 is connected to the first lifter 500*a*, and the guide slope 126 is connected to the second lifter 500*b*, as described above. The special game medium stored in each guide slope is discharged to the first lifter 500*a* or the second lifter 500*b* in a first-in, first-out manner each time another special game medium is captured and stored.

The guide slopes 124 and 126 respectively include token sensors 134 and 136 that are provided in the upper portion of the slope, detect passage of the special game medium, and output a detection signal to the control unit 40 (FIGS. 4 and 5). The token sensors 134 and 136 are provided at positions that satisfy a positional relationship in which, when each guide slope has stored the special game media in a number corresponding to a given upper limit, the special game medium that has been stored latest reaches the detection positions of the token sensors 134 and 136 and the token sensors 134 and 136 continuously output detection signals. Specifically, when the detection signals are input from the token sensors 134 and 136 for a short period of time within a reference time, the control unit 40 determines that the detection signals indicate passage of the special game medium, and that the special game media in a number corresponding to the given upper limit have not been stored in the guide slopes 124 and 126. On the other hand, when the detection signals are input for a period of time exceeding the reference time, the control unit 40 determines that the special game media in a number corresponding to the given upper limit have been stored in the guide slopes 124 and 126.

The first lifter 500*a* and the second lifter 500*b* are described below. The first lifter 500*a* and the second lifter 500*b* according to this embodiment have an identical basic structure except that the first lifter 500*a* and the second lifter 500*b* handle the special game media that differ in size. Therefore, the following description is given taking the first lifter 500*a* as a representative example.

Figure 11:
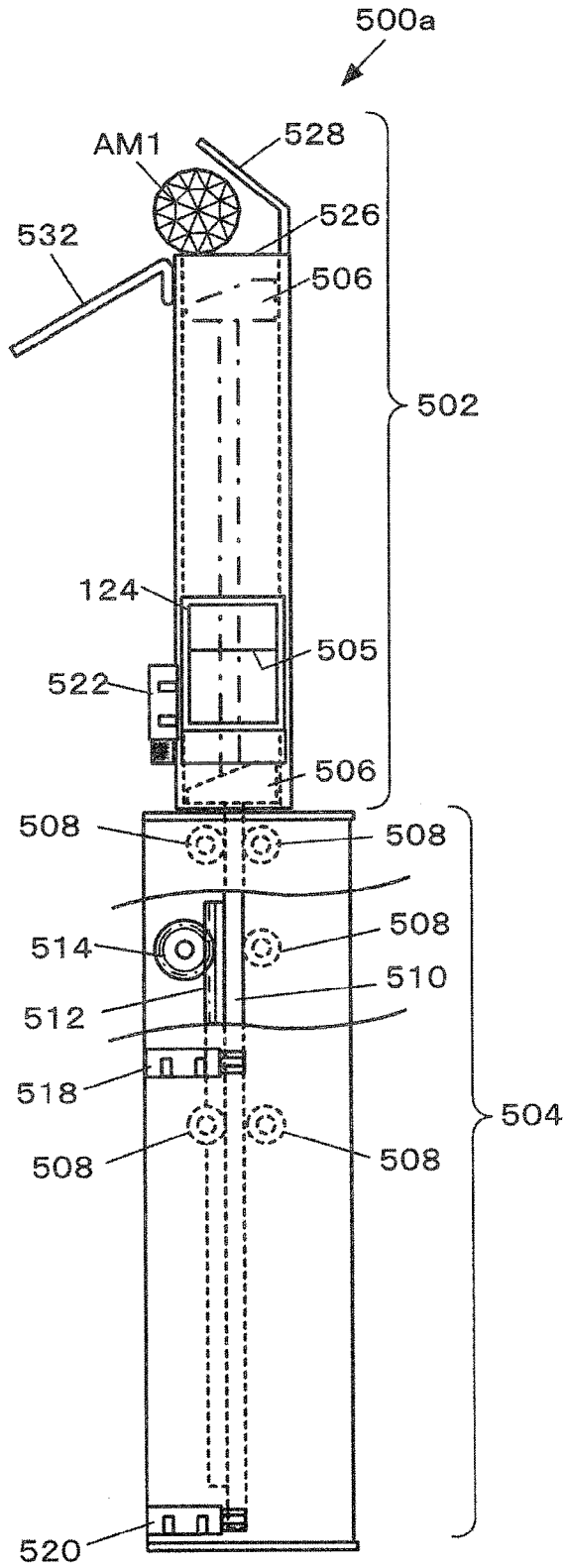
FIG. 11 is a view showing a configuration example of a first lifter.
Figure 12:
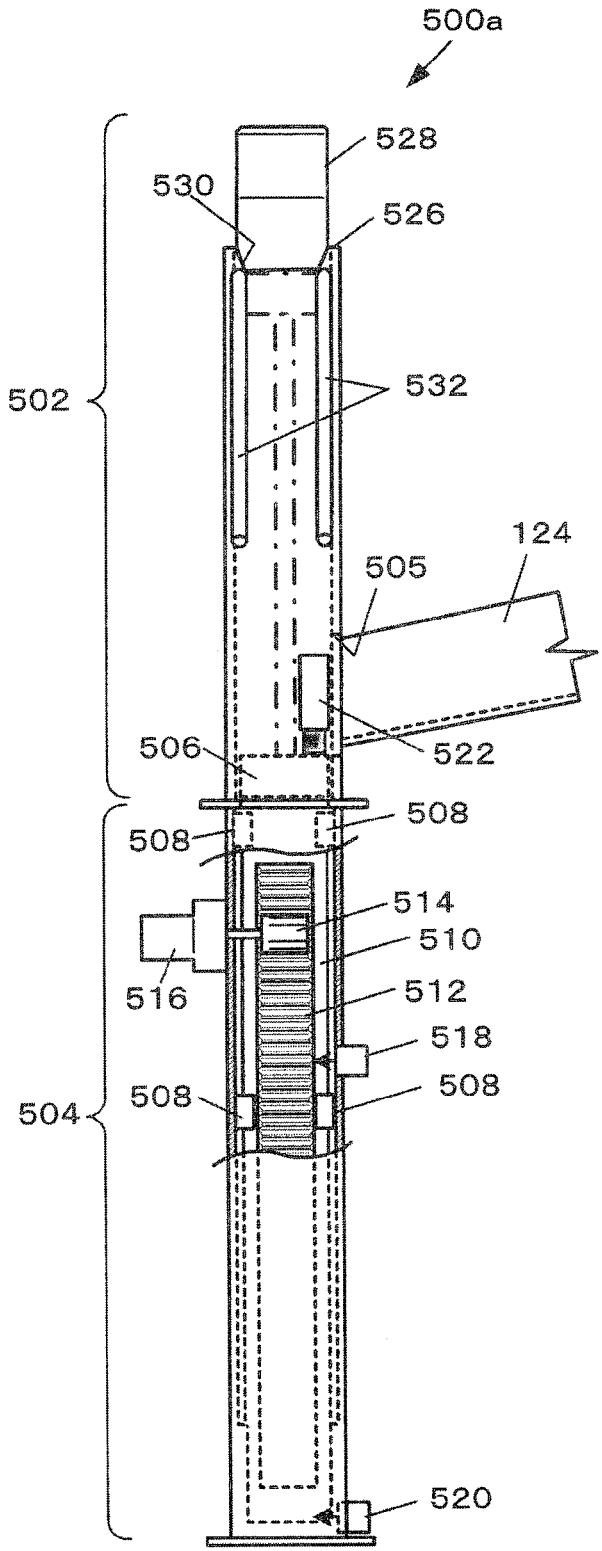
FIG. 12 is a right side view showing a configuration example of the first lifter.

FIGS. 11 and 12 are views showing a configuration example of the first lifter 500*a* according to this embodiment. FIG. 11 is a front view, and FIG. 12 is a right side view. As shown in FIGS. 11 and 12, the first lifter 500*a* generally has a vertically long shape. The first lifter 500*a* includes a hollow columnar section 502 that is provided in the upper portion of the first lifter 500*a* and has open upper and lower ends, and a push-up mechanism section 504 that is provided in the lower portion of the first lifter 500*a* and pushes up the first special game medium AM1 inside the hollow columnar section 502.

The hollow columnar section 502 forms a hollow portion into which the first special game medium AM1 can be inserted. The hollow columnar section 502 includes an entrance 505 that is provided on the front lower end and is connected to the guide slope 124 of the sort/discharge section 100 so that the first special game medium AM1 that rolls down along the guide slope 124 due to its weight can be introduced into the hollow portion. A moving section 506 that is moved up and down in the hollow portion by the push-up mechanism section 504 is disposed in the hollow columnar section 502.

The push-up mechanism section 504 includes a push rod 510 that forms a rack on the side and is supported by guide rollers 508 to be slidable in the vertical direction, a pinion gear 514 that engages a rack 512 of the push rod 510, a motor 516 that is controlled by the control unit 40, the pinion gear 514 being connected to a rotary shaft of the motor 516, a position sensor 518 that detects the upper limit position of the push rod 510, a position sensor 520 that detects the lower limit position of the push rod 510, and an entrance detection sensor 522 that detects the first special game medium AM1 on the moving section 506.

The position sensors 518 and 520 are sensors that detect the lower end of the push rod 510 and output detection signals to the control unit 40. For example, the position sensors 518 and 520 are implemented by a shading sensor, a gap sensor, a swing switch, a range sensor, or the like. The entrance detection sensor 522 is a sensor that detects the first special game medium AM1 on the moving section 506 and outputs a detection signal to the control unit 40. For example, the entrance detection sensor 522 is implemented by a shading sensor, a swing switch, a range sensor, or the like.

When the first special game medium AM1 is not detected by the entrance detection sensor 522 (i.e., when the first special game medium AM1 is not contained in the hollow columnar section 502), the control unit 40 drives the motor 516 according to a given program to move the push rod 510 to the lower limit position. When the control unit 40 has received the detection signal from the entrance detection sensor 522 and received the detection signal from the token sensor 134 of the guide slope 124, the control unit 40 moves the push rod 510 upward to the upper limit position. Therefore, the first special game medium AM1 that has entered the hollow columnar section 502 is lifted to the upper opening 526 together with the moving section 506. Specifically, when the control unit 40 has detected that the first special game medium AM1 to be lifted is contained in the hollow portion 502 and another special game medium has entered the guide slope 124 (i.e., reception section), the first special game medium AM1 in the hollow portion 502 is lifted.

In FIG. 11, the upper portion of the right wall of the hollow columnar section 502 diagonally extends over the upper opening 526 in the upper left direction so that a discharge guide 528 is formed. A hollow portion 530 is formed on the left side of the upper opening 526 in FIG. 11 so that the first special game medium AM1 easily rolls out from the hollow columnar section 502. Therefore, the first special game medium AM1 lifted to the upper opening 526 is pushed leftward due to collision with the slope formed by the discharge guide 528, and rolls out through the hollow portion 530.

A guide rail 532 having a width smaller than the diameter D1 of the first special game medium AM1 is provided on the left side of the upper end of the hollow columnar section 502 downward from the position of the hollow portion 530.

In this embodiment, the first lifter 500*a* is configured so that the upper portion of the hollow columnar section 502 protrudes into the game space GS (see FIG. 1), and the end of the guide rail 532 is directed toward the upper side of the pusher table 508. Therefore, the first special game medium AM1 is captured, sorted, and transferred to the first lifter 500*a* by the sort/discharge section 100, and is supplied to the upper side of the pusher table 508 by the first lifter 500*a* so that the first special game medium AM1 is again placed on the upper side of the pusher table 508.

The second lifter 500*b* is configured so that the inner dimensions of the hollow columnar section 502, the shape of the entrance 505, and the width of the guide rail 532 are designed corresponding to the second special game medium AM2. The guide slope 126 is connected to the entrance 505. The upper portion of the hollow columnar section 502 protrudes into the game space GS, and the end of the guide rail 532 is directed toward the upper side of the stationary table 506. Therefore, the second special game medium AM2 is captured, sorted, and transferred to the second lifter 500*b* by the sort/discharge section 100, and is supplied to the upper side of the stationary table 506 by the second lifter 500*b* so that the second special game medium AM2 is again placed on the upper side of the stationary table 506.

According to the above configuration, even when a plurality of types of special game media are used as the game media that fall into the token chute 4, the token and each special game medium can be sorted, transferred, and stored. The special game media that have been stored can be supplied (circulated) to the game space. This makes it possible to implement various types of lotteries and processes using a plurality of types of special game media, whereby game playability can be improved.

Moreover, since the sort/discharge section 100 according to this embodiment is configured so that the spiral rod 110 has a function of a means that captures the special game medium in addition to a function of a transfer means, an increase in size of the token game machine 1000 can be suppressed even when using a plurality of types of special game media. According to this embodiment, since the spiral rod 110 can be used as a transfer means for the first special game medium AM1 and the second special game medium AM2, the structure for capturing and transferring the special game medium can be further simplified and reduced in size, whereby the production cost can be reduced.

Moreover, only one first special game medium AM1 or second special game medium AM2 engages the spiral rod 110 corresponding to one pitch. Therefore, the first special game medium AM1 and the second special game medium AM2 can be moved individually, whereby the first special game medium AM1 and the second special game medium AM2 can be reliably transferred without clogging. Furthermore, even if the first special game medium AM1 or the second special game medium AM2 is not a rolling element, or the center-of-gravity position of the first special game medium AM1 or the second special game medium AM2 is displaced to a large extent (e.g., when an object corresponding to a weight is enclosed in a resin capsule), the first special game medium AM1 or the second special game medium AM2 can be captured and reliably transferred from the capturing position.

Modification

The embodiments to which the invention is applied have been described above. Note that the invention is not limited to the above-described embodiments. The elements may be appropriately added, modified, or omitted without departing from the spirit and scope of the invention.

In the above-described embodiments, the spiral rod 110 is used as the special game medium moving/transferring means of the sort/discharge section 100, for example. Note that the invention is not limited thereto.

Figure 13:
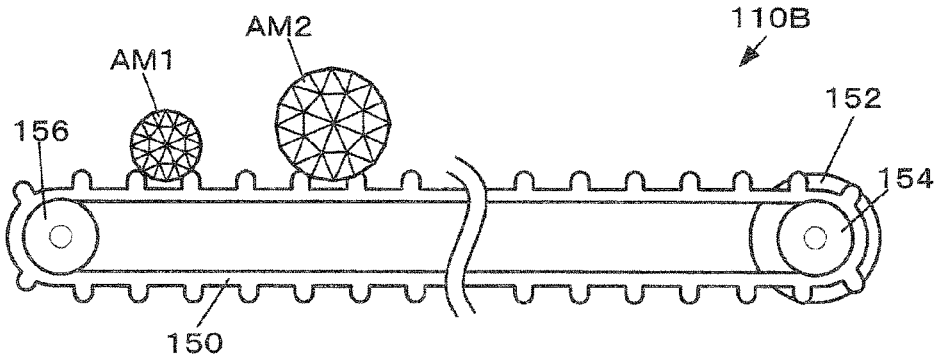
FIG. 13 is a front view showing a modification of a transfer mechanism.

FIG. 13 is a front view showing a modification of the transfer mechanism that replaces the spiral rod 110, for example. As shown in FIG. 13, a belt mechanism 110B formed by providing a belt 150 with external teeth around a drive pulley 154 driven by a motor 152 and a driven pulley 156 may be used instead of the spiral rod 110. The belt 150 with external teeth is formed of an elastic body such as a synthetic rubber or a silicone rubber, and has a given width in the depth direction in FIG. 13. The external teeth correspond to the protrusion formed by the wire 110*b* of the spiral rod 110. A depression is formed between the external teeth so that only one first special game medium AM1 or second special game medium AM2 is placed in one depression.

Figure 14:
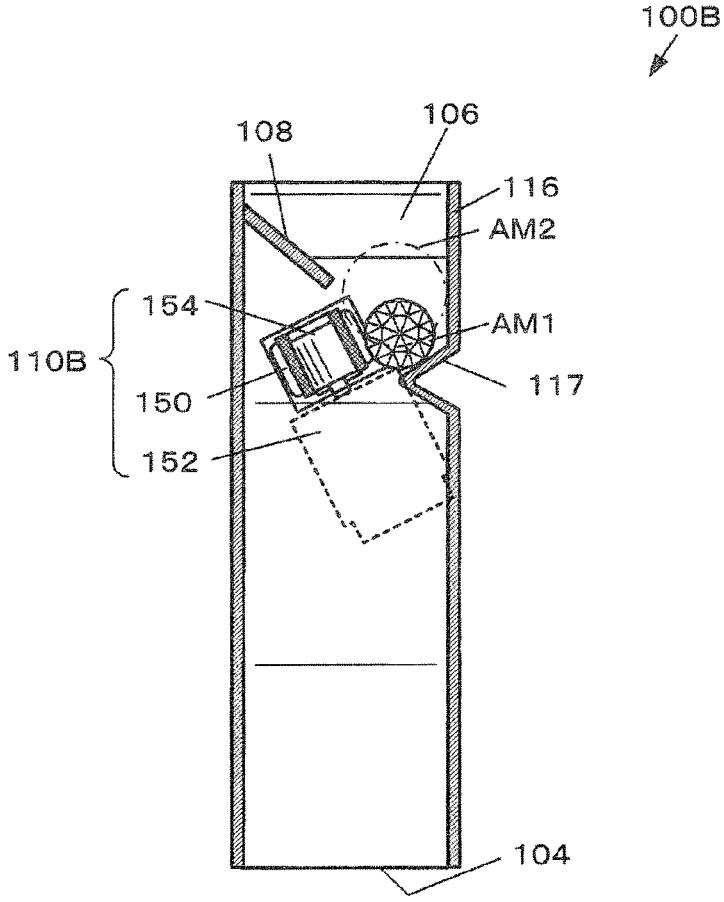
FIG. 14 is a vertical cross-sectional view showing a sort/discharge section utilizing a modification of a transfer mechanism.

As shown in FIG. 14 which is a cross-sectional view showing a sort/discharge section 100B along the line VIC-VIC (see FIG. 4) (i.e., a cross-sectional view corresponding to FIG. 6 which is a cross-sectional view along the line VIC-VIC shown in FIG. 4 according to the above-described embodiment), the belt 150 with external teeth is disposed in the sort/discharge section 100B in an inclined state along the transfer path of the special game medium so that the belt transfer side (outer side of the belt that faces rearward) diagonally faces upward and rearward. In this case, the distance between the belt transfer side of the belt 150 with external teeth and the rear wall 116 (i.e., the inner wall of the fall passage) along the direction normal to the belt transfer side corresponds to the opening W2, and the distance between the outer side of the belt 150 with external teeth that faces rearward and the rear wall 116 (i.e., extruded section 117) corresponds to the opening W1. Therefore, the second special game medium AM2 that has fallen into the token chute 4 is captured at the opening between the belt 150 with external teeth and the rear wall 116, while the first special game medium AM1 and the token M pass through the opening between the belt 150 with external teeth and the rear wall 116. The first special game medium AM1 that passed through the opening between the belt 150 with external teeth and the rear wall 116 is captured at the opening between the belt 150 with external teeth and the extruded section 117 of the rear wall 116, and only the token M reaches the lower opening 104. The configuration using the belt mechanism 110B can also achieve the same effects as those of the configuration using the spiral rod 110.

The extruded section 117 according to this modification may also be applied to the first embodiment. Note that the extruded section 117 may not be formed by extruding the rear wall 116. For example, a configuration may be employed in which the rear wall 116 may be formed as a slope that inclines forward by forming the fall passage in the shape of a funnel in the back and forth direction so that the distance between the rear wall 116 and the spiral rod 110 decreases as the distance from the upper opening 102 increases.

Figure 15:
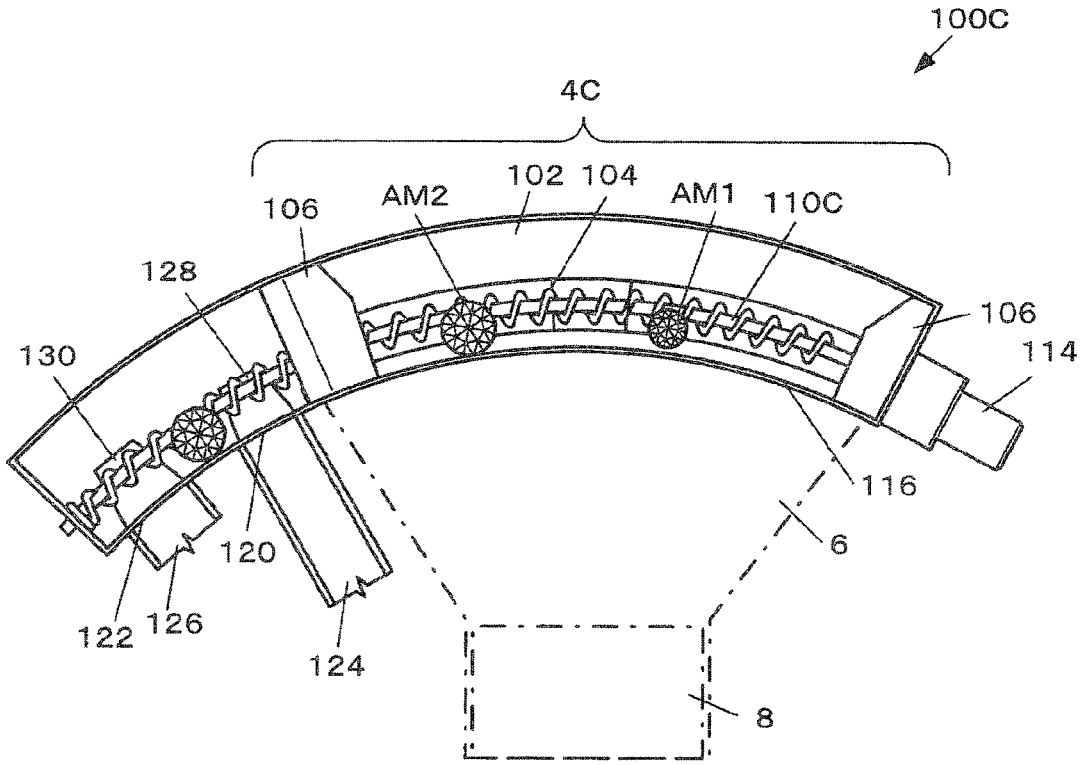
FIG. 15 is a schematic top view showing a portion around a token chute when using a modification of a sort/discharge section formed so that the transfer path is curved.
Figure 16:
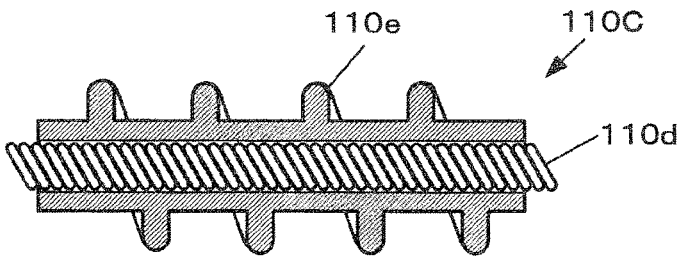
FIG. 16 is a partial cross-sectional view showing a configuration example of a spiral rod in a modification of a sort/discharge section formed so that the transfer path is curved.

In the first embodiment, the token chute 4 has a rectangular (oblong) shape in the right and left direction, and the spiral rod 110 is linearly formed to form a linear transfer path. Note that the invention is not limited thereto. As shown in FIG. 15 (schematic top view showing a portion around the token chute), a sort/discharge section 100C (i.e., token chute) may be formed in the shape of an arc (4C in FIG. 15), for example. As shown in of FIG. 16 (partial vertical cross-sectional view), a spiral rod 110C is formed by providing a flexible rod 110*d* having a flexible spiral structure in an elastic rubber tube 110*e* around which a spiral fin is wound.

The spiral rod 110C has a positional relationship with the rear wall 116 similar to that of the spiral rod 110 according to the first embodiment to form the opening W1 and the opening W2. The right end of the spiral rod 10C is connected to the rotary shaft of the motor 114, and the left end of the spiral rod 110C is pivotally supported by the left wall of the sort/discharge section 100C. As a result, the spiral rod 110C is supported in a curved state along the arc of the token chute 4B due to the elasticity that recovers the linear state. The curved state is maintained even if the spiral rod 110C is rotated by the motor 114. The spiral fin formed around the spiral rod 110C engages the first second special game medium and the second special game medium, and moves the first second special game medium and the second special game medium. Therefore, a transfer path including a curve can be formed so that the token chute 4 can be curved while maintaining the function of the sorting/transferring section.

The above-described embodiments illustrate an example in which the number of types of special game media is two. Note that the number of types of special game media may be three or more. The game process can be further provided with variety by increasing the number of types of lotteries correspondingly, whereby game playability can be improved. The special game media may have a different external shape.

The application of the special game medium is not limited to the lottery trigger means. The special game medium may be used as a physical privilege granting means. For example, the second special game medium AM2 is formed using a resin capsule that can be opened, and a plurality of tokens M are enclosed in the resin capsule. A privilege discharge port is provided in the token game machine 1000, and the second rear side opening 122 is connected to the discharge port through a passage and a transport device to form a special game medium discharge section. In this case, if the second special game medium AM2 is discharged when the second special game medium AM2 rolls or falls spontaneously, the inclination angle of the passage that connects the privilege discharge port and the second rear side opening 122 must be set to be larger than the stationary limit angle θLimit. According to this configuration, the first special game medium AM1 and the second special game medium AM2 can be captured and transferred by the sort/discharge section 100, and the first special game medium AM1 can be stored in the guide slope 124 while the second special game medium AM2 can be sorted and discharged. This makes it possible to utilize the special game medium as a physical privilege granting means while improving game playability using a plurality of types of special game media.

Note that the first special game medium AM1 may be discharged instead of the second special game medium AM2. When a special game medium supply mechanism is provided without circulating the special game medium, the first special game medium AM1 and the second special game medium AM2 may be sorted and discharged.

The push-up control of the first lifter 500*a* and the second lifter 500*b* is not limited to that of the above-described embodiments. The above-described embodiments illustrate an example in which one first special game medium AM1 is lifted by the first lifter 500*a* and supplied to the game space GS when the first special game medium AM1 has been additionally stored in the guide rail 124. For example, a plurality of first special game media AM1 may be collectively supplied by repeating the push-up process when granting a privilege. This also applies to control of the second lifter 500*b*.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention.

What is claimed is:

1. A token game machine comprising:

a token placement section; a token, a first special game medium, and a second special game medium that is larger than the first special game medium being placed on the token placement section, a token chute;

a pusher section that pushes an object placed on the token placement section;

a capture/transfer section that captures the first special game medium and the second special game medium that have fallen into the token chute and transfers the first special game medium and the second special game medium to a given transfer destination; and a reception section that discriminatingly receives the first special game medium and the second special game medium transferred from the capture/transfer section, wherein the reception section includes:

a first reception section that receives the first special game medium that has passed through a first entrance, the first entrance having a size that allows the first special game medium to pass through, but does not allow the second special game medium to pass through; and a second reception section that receives the second special game medium that has passed through a second entrance, the second entrance having a size that allows the second special game medium to pass through, the first entrance being disposed on an upstream side as compared with the second entrance along a transfer path of the capture/transfer section.

2. A token game machine comprising:

a token placement section; a token, a first special game medium, and a second special game medium that is larger than the first special game medium being placed on the token placement section, a token chute;

a pusher section that pushes an object placed on the token placement section;

a capture/transfer section that captures the first special game medium and the second special game medium that have fallen into the token chute and transfers the first special game medium and the second special game medium to a given transfer destination;

a reception section that receives one of the first special game medium and the second special game medium transferred from the capture/transfer section; and a special game medium discharge section that discharges the other of the first special game medium and the second special game medium transferred from the capture/transfer section, wherein the reception section includes:

a first reception section that receives the first special game medium that has passed through a first entrance, the first entrance having a size that allows the first special game medium to pass through, but does not allow the second special game medium to pass through; and a second reception section that receives the second special game medium that has passed through a second entrance, the second entrance having a size that allows the second special game medium to pass through, the first entrance being disposed on an upstream side as compared with the second entrance along a transfer path of the capture/transfer section.

3. The token game machine as defined in claim 1, wherein the capture/transfer section includes a spiral transfer mechanism having a spiral section disposed along a given transfer path, an opening that allows the token to pass through, but does not allow the first special game medium to pass through being formed between the spiral transfer mechanism and an inner wall of a fall passage for the token that has fallen into the token chute.

4. The token game machine as defined in claim 2, wherein the capture/transfer section includes a spiral transfer mechanism having a spiral section disposed along a given transfer path, an opening that allows the token to pass through, but does not allow the first special game medium to pass through being formed between the spiral transfer mechanism and an inner wall of a fall passage for the token that has fallen into the token chute.

5. The token game machine as defined in claim 1, wherein the token game machine further includes a guide section provided along a transfer path of the capture/transfer section, the guide section coming in contact with the first special game medium and the second special game medium that have fallen into the token chute, and the capture/transfer section includes a spiral transfer mechanism having a spiral section disposed along a given transfer path, an opening that allows the token to pass through, but does not allow the first special game medium to pass through being formed between the spiral transfer mechanism and the guide section.

6. The token game machine as defined in claim 2, wherein the token game machine further includes a guide section provided along a transfer path of the capture/transfer section, the guide section coming in contact with the first special game medium and the second special game medium that have fallen into the token chute, and the capture/transfer section includes a spiral transfer mechanism having a spiral section disposed along a given transfer path, an opening that allows the token to pass through, but does not allow the first special game medium to pass through being formed between the spiral transfer mechanism and the guide section.

7. The token game machine as defined in claim 3, wherein the spiral section includes a shaft and a spiral member spirally provided around the shaft, the first special game medium and the second special game medium being rolled and transferred by the spiral member due to rotation of the spiral section.

8. The token game machine as defined in claim 4, wherein the spiral section includes a shaft and a spiral member spirally provided around the shaft, the first special game medium and the second special game medium being rolled and transferred by the spiral member due to rotation of the spiral section.

9. The token game machine as defined in claim 5, wherein the spiral section includes a shaft and a spiral member spirally provided around the shaft, the first special game medium and the second special game medium being rolled and transferred by the spiral member due to rotation of the spiral section.

10. The token game machine as defined in claim 6, wherein the spiral section includes a shaft and a spiral member spirally provided around the shaft, the first special game medium and the second special game medium being rolled and transferred by the spiral member due to rotation of the spiral section.

11. The token game machine as defined in claim 7, wherein the spiral section is configured so that the spiral member and the shaft allow only one first game medium or second special game medium to be positioned within one spiral pitch.

12. The token game machine as defined in claim 8, wherein the spiral section is configured so that the spiral member and the shaft allow only one first game medium or second special game medium to be positioned within one spiral pitch.

13. The token game machine as defined in claim 9, wherein the spiral section is configured so that the spiral member and the shaft allow only one first game medium or second special game medium to be positioned within one spiral pitch.

14. The token game machine as defined in claim 10, wherein the spiral section is configured so that the spiral member and the shaft allow only one first game medium or second special game medium to be positioned within one spiral pitch.

15. The token game machine as defined in claim 1, wherein the capture/transfer section includes a belt transfer mechanism having a belt transfer side, the belt transfer side and an inner wall of a fall passage for the token being positioned to have an opening that allows the token to pass through, but does not allow the first special game medium to pass through.

16. The token game machine as defined in claim 2, wherein the capture/transfer section includes a belt transfer mechanism having a belt transfer side, the belt transfer side and an inner wall of a fall passage for the token being positioned to have an opening that allows the token to pass through, but does not allow the first special game medium to pass through.

17. The token game machine as defined in claim 1, wherein the token game machine further includes a guide section provided along a transfer path of the capture/transfer section, the guide section coming in contact with the first special game medium and the second special game medium that have fallen into the token chute, and the capture/transfer section includes a belt transfer mechanism having a belt transfer side, the belt transfer side and the guide section being positioned to have an opening that allows the token to pass through, but does not allow the first special game medium to pass through.

18. The token game machine as defined in claim 2, wherein the token game machine further includes a guide section provided along a transfer path of the capture/transfer section, the guide section coming in contact with the first special game medium and the second special game medium that have fallen into the token chute, and the capture/transfer section includes a belt transfer mechanism having a belt transfer side, the belt transfer side and the guide section being positioned to have an opening that allows the token to pass through, but does not allow the first special game medium to pass through.

19. The token game machine as defined in claim 17, wherein the belt transfer side defines depressions being successively in the belt transfer side, each of the depressions being configured to receive only one first special game medium or second special game medium.

20. The token game machine as defined in claim 1, wherein both the first special game medium and the second special game medium are one rolling element that spontaneously rolls on an inclined surface, when the inclined surface is larger than a stationary limit angle.

21. The token game machine as defined in claim 2, wherein both the first special game medium and the second special game medium are one rolling element that spontaneously rolls on an inclined surface, when the inclined surface is larger than a stationary limit angle.

* * * * *